US009280929B2

(12) United States Patent
In et al.

(10) Patent No.: US 9,280,929 B2
(45) Date of Patent: Mar. 8, 2016

(54) DISPLAY DEVICE AND METHOD FOR DRIVING THE SAME

(71) Applicant: SAMSUNG DISPLAY CO., LTD., Yongin-si, Gyeonggi-do (KR)

(72) Inventors: Hai-Jung In, Seoul (KR); Yong-Sung Park, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/504,331

(22) Filed: Oct. 1, 2014

(65) Prior Publication Data

US 2015/0302793 A1 Oct. 22, 2015

(30) Foreign Application Priority Data

Apr. 16, 2014 (KR) ..... 10-2014-0045314

(51) Int. Cl.
*G09G 3/20* (2006.01)
*G09G 3/32* (2006.01)
*G09G 5/18* (2006.01)

(52) U.S. Cl.
CPC ..... *G09G 3/3208* (2013.01); *G09G 5/18* (2013.01); *G09G 2300/0426* (2013.01)

(58) Field of Classification Search
CPC ..... G01N 2333/90287; G01N 2333/912; G01N 2333/952; G01N 2333/96458; G01N 2469/20; G01N 2800/26; G01N 2800/324
See application file for complete search history.

(56) References Cited

U.S. PATENT DOCUMENTS 6,252,215 B1 * 6/2001 Mei ..... H01L 27/14609 250/208.1
8,441,018 B2 * 5/2013 Lee ..... H04N 9/315 257/75
2006/0030084 A1 * 2/2006 Young ..... H01L 27/1214 438/149
2007/0024547 A1 * 2/2007 Jang ..... G09G 3/3233 345/81
2007/0236429 A1 10/2007 Tseng et al.

FOREIGN PATENT DOCUMENTS

| | | |
|---|---|---|
| JP | 2007-072305 | 3/2007 |
| KR | 10-2004-0037829 | 5/2004 |
| KR | 10-2004-0051621 | 6/2004 |
| KR | 10-0547515 | 1/2006 |
| KR | 10-2007-0020431 | 2/2007 |
| KR | 10-2007-0035530 | 3/2007 |
| WO | WO 03/038790 A2 | 5/2003 |
| WO | WO 2005/081810 A2 | 9/2005 |
| WO | WO 2006/005033 A2 | 1/2006 |

* cited by examiner

*Primary Examiner* — Olga Merkoulova
(74) *Attorney, Agent, or Firm* — Lewis Roca Rothgerber Christie LLP

(57) ABSTRACT

Each pixel of a display device includes: an organic light emitting diode between a first and a second power supply; a first transistor to transmit a drive current based on data signals; a second transistor to couple a gate electrode of the first transistor to the data line in response to a scan signal; a first capacitor between the first power supply and the gate electrode of the first transistor; a light receiving element coupled to a third power supply; a second capacitor between the light receiving element and a fourth power supply; a third transistor between the data line and a first electrode of the second capacitor, the third transistor including a gate electrode coupled to a selection signal line; and a fourth transistor between the fourth power supply and the third transistor, the fourth transistor including a gate electrode coupled to the first electrode of the second capacitor.

15 Claims, 9 Drawing Sheets

DISPLAY DEVICE AND METHOD FOR DRIVING THE SAME

CROSS-REFERENCE TO RELATED APPLICATION

This application claims priority to and the benefit of Korean Patent Application No. 10-2014-0045314, filed on Apr. 16, 2014, with the Korean Intellectual Property Office, the disclosure of which is incorporated herein in its entirety by reference.

BACKGROUND

1. Field

Embodiments of the present invention relate to a display device.

2. Description of Related Art

Various types of flat panel displays (FPDs) that have reduced weight and volume compared to a cathode ray tube (CRT) are currently being developed. The FPDs include liquid crystal displays (LCDs), field emission displays (FEDs), plasma display panels (PDPs), organic light emitting diode (OLED) displays, and the like.

Among the FPDs, the OLED display displays images using organic light emitting diodes (OLEDs) that generate light by recombining electrons and holes, and it is drawing attention owing to aspects such as short response time, low power consumption, high luminous efficiency, increased (e.g., improved) luminance and increased viewing angle.

The OLED display can be generally classified into two types according to the driving method of the OLED: a passive-matrix OLED (PMOLED) and an active-matrix OLED (AMOLED).

Of the two types, the active-matrix OLED, in which unit pixels are selectively lit in terms of resolution, contrast, and operation speed, is primarily used. One pixel of the active-matrix OLED includes an OLED, a first transistor for controlling an amount of current applied to the OLED, and a switching transistor for transmitting a data signal to the first transistor so as to control an amount of light emitted by the OLED.

When an OLED emits light over a long period of time, light output amounts of each pixel may appear different from each other and image quality may be degraded because of luminance non-uniformity.

Therefore, a pixel compensation circuit may be included to output uniform luminance by detecting degradation information of a pixel and transmitting a corrected data signal to a degraded pixel.

It is to be understood that this background section is intended to provide useful background for understanding embodiments of the present invention and as such, the background section may include ideas, concepts or recognitions that were not part of what was known or appreciated by those skilled in the pertinent art prior to corresponding effective filing dates of subject matter disclosed herein.

SUMMARY

Aspects of embodiments of the present invention are directed to a display device and a driving method thereof. Further, aspects of embodiments of the present invention are directed to a high-quality and high-definition display device in which a gray level of a pixel is correctly displayed by a photo-sensing unit disposed in a pixel circuit, and a method of driving the display device.

According to one embodiment of the present invention, a display device includes: a scan driver configured to transmit a plurality of scan signals to a plurality of scan lines; a data driver configured to transmit a plurality of data signals to a plurality of data lines; a selector driver configured to transmit a plurality of selection signals to a plurality of selection signal lines; a sensor driver configured to receive a plurality of output signals through the plurality of data lines; and a plurality of pixels coupled to the scan lines, the data lines, and the selection signal lines, wherein each of the plurality of pixels includes: an organic light emitting diode between a first power supply and a second power supply; a first transistor configured to transmit a drive current based on the data signals to the organic light emitting diode; a second transistor configured to couple a gate electrode of the first transistor to the data line in response to one of the plurality of scan signals; a first capacitor between the first power supply and the gate electrode of the first transistor; a light receiving element coupled to a third power supply; a second capacitor between the light receiving element and a fourth power supply; a third transistor between the data line and a first electrode of the second capacitor, the third transistor including a gate electrode coupled to one of the plurality of selection signal lines; and a fourth transistor between the fourth power supply and the third transistor, the fourth transistor including a gate electrode coupled to the first electrode of the second capacitor.

The light receiving element may include at least one of a PIN diode in which a cathode is coupled to the third power supply and an anode is coupled to the first electrode of the second capacitor, a PN diode, or a photocoupler.

The third transistor may include a first electrode coupled to the data line and a second electrode coupled to the first electrode of the fourth transistor.

The fourth transistor may include a first electrode coupled to a second electrode of the third transistor and include a second electrode coupled to the fourth power supply.

The display device may further include a first switch between the data driver and the data line.

The display device may further include a second switch between the sensor driver and the data line.

The display device may further include: a fifth power supply; and a third switch between the fifth power supply and the second switch.

The sensor driver may include an analog-to-digital converter (ADC) coupled to the data line.

According to another embodiment of the present invention, there is provided a method of driving a display device including: a scan driver configured to transmit a plurality of scan signals to a plurality of scan lines; a data driver configured to transmit a plurality of data signals to a plurality of data lines; a selector driver configured to transmit a plurality of selection signals to a plurality of selection signal lines; a sensor driver configured to receive a plurality of output signals through the plurality of data lines; and a plurality of pixels coupled to the scan lines, the data lines, and the selection signal lines; a first switch between the data driver and the data line; a second switch between the sensor driver and the data line; and a third switch between a fifth power supply and the second switch, wherein each of the plurality of pixels includes: an organic light emitting diode (OLED) between a first power supply and a second power supply; a first transistor configured to transmit a drive current based on the data signals to the OLED; a second transistor configured to couple a gate electrode of the first transistor to the data line in response to one of the plurality of scan signals; a first capacitor between the first power supply and the gate electrode of the first transistor; a light receiving element coupled to a third power supply; a second capacitor between the light receiving element and a fourth power supply; a third transistor between the data line and a first electrode of the second capacitor, the third transistor including the gate electrode coupled to one of the plurality of selection signal lines; and a fourth transistor between the fourth power supply and the third transistor, the fourth transistor including the gate electrode coupled to the first electrode of the second capacitor, the method including: initial voltage storing in which a voltage of a first electrode of the third transistor is stored in the sensor driver through the data line; photosensing in which the OLED emits light by drive current based on one of the plurality of data signals and a voltage of the second capacitor varies with photo-leakage current generated according to intensity of light incident onto the light receiving element; and detected voltage storing in which the voltage of the first electrode of the third transistor reflecting the varying voltage of the second capacitor is stored in the sensor driver through the data line.

The method may further include: calculating a voltage variation of the second capacitor by a comparison of the initial voltage and the detected voltage by the sensor driver; determining degradation information of each pixel utilizing the voltage variation of the second capacitor; and transmitting a corrected data signal to a degraded pixel.

The initial voltage storing may include: a first step in which the first switch is turned off, the second switch is turned on, the third switch is turned on, a third power supply voltage is applied to a cathode of the light receiving element, the third transistor is switch-operated in accordance with the selection signals so as to couple a first electrode of the fourth transistor to the data line, the second transistor is turned off, and a fifth power supply voltage is applied to the first electrode of the third transistor through the data line; and a second step in which the third switch is turned off, and the voltage of the first electrode of the third transistor is stored in the sensor driver through the data line.

During the first step, the first switch may be turned off so as to disconnect the data driver from the data line, the second switch may be turned on so as to couple the sensor driver and the data line, the third switch may be turned on so as to couple the fifth power supply voltage and the data line, and the third power supply voltage may be applied to the cathode of the light receiving element such that a voltage corresponding to the third power supply voltage is stored in the second capacitor.

During the photosensing, the first switch may be turned on, the second switch may be turned off, the third switch may be turned off, the second transistor may be switch-operated based on the data signals such that the gate electrode of the first transistor is coupled to the data line, the third transistor may be turned off, and the voltage of the second capacitor may vary with photo-leakage current generated according to intensity of light incident onto the light receiving element.

The detected voltage storing may include: a fourth step in which the first switch is turned off, the second switch is turned on, the third switch is turned on, the third transistor is switch-operated in accordance with the selection signals so as to couple the first electrode of the fourth transistor to the data line, the second transistor is turned off, and the fifth power supply is applied to the first electrode of the third transistor through the data line; and a fifth step in which the third switch is turned off, and the voltage of the first electrode of the fourth transistor reflecting the voltage of the second capacitor, which varies during the photosensing, is stored in the sensor driver through the data line.

During the fourth step, the first switch may be turned off so as to disconnect the data driver from the data line, the second switch may be turned on so as to couple the sensor driver and the data line, and the third switch may be turned on so as to couple the fifth power supply and the data line.

According to embodiments of the present invention, a display device may detect a degraded pixel and may apply a corrected data voltage to the degraded pixel, thereby reducing pixel degradation, and thus the display device may be realized to have high quality and high definition.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present invention will be more clearly understood from the following detailed description, taken in conjunction with the accompanying drawings, in which.

DETAILED DESCRIPTION

Figure 1:
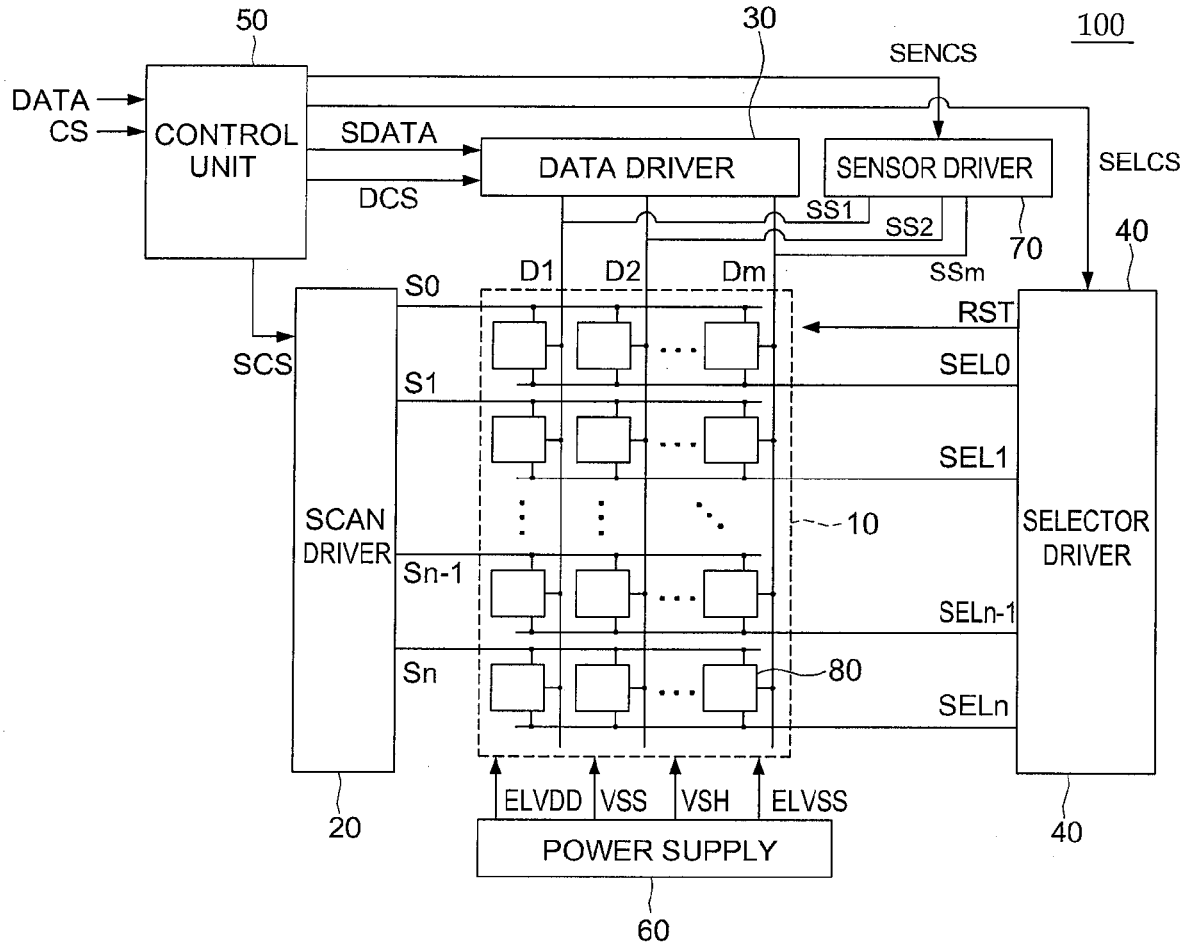
FIG. 1 is a schematic block diagram illustrating a display device according to an embodiment of the present invention.

Aspects and features of the present invention and methods for achieving them will be made clear from embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the present invention to those skilled in the art. The present invention is merely defined by the scope of the claims, and equivalents thereof. Therefore, well-known constituent elements, operations and techniques are not described in detail in the embodiments in order to prevent the present invention from being obscurely interpreted. Like reference numerals refer to like elements throughout the specification.

The spatially relative terms “below”, “beneath”, “lower”, “above”, “upper”, and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device shown in the drawing is turned over, the device positioned “below” or “beneath” another device may be placed "above" another device. Accordingly, the illustrative term "below" may include both the lower and upper positions. The device may also be oriented in the other direction, and thus the spatially relative terms may be interpreted differently depending on the orientations.

The terminology used herein is for the purpose of describing particular embodiments only and is not construed as limiting the present invention. As used herein, the singular forms "a," "an" and "the" are intended to include the plural forms as well, unless the context clearly indicates otherwise. It will be further understood that the terms "comprises" and/or "comprising," when used in this specification, specify the presence of mentioned component, step, operation and/or element, but do not exclude the presence or addition of one or more other components, steps, operations and/or elements.

Unless otherwise defined, all terms used herein (including technical and scientific terms) have the same meaning as commonly understood by those skilled in the art to which the present invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

When a "first element" is described as being "coupled to" or "connected to" a second element, the first element may be "coupled" or "connected" directly to each other, or may be indirectly coupled to each other with one or many intervening elements interposed therebetween.

Hereinafter, a display device and a driving method thereof according to an embodiment of the present invention will be described in detail with reference to FIGS. 1, 2, 3, 4, 5A, 5B, and 5C.

FIG. 1 is a schematic block diagram illustrating a display device according to an embodiment of the present invention.

Referring to FIG. 1, according to an embodiment of the present invention, the display device 100 includes a display panel 10 including a plurality of pixels, a scan driver 20 configured to apply a scan signal to a pixel circuit, a data driver 30 configured to supply a data signal to the pixel circuit through a data line, a selector driver 40 configured to supply a selection signal to a sensing unit (or sensor) of the pixel circuit, a control unit (or controller) 50, and a power supply unit (or power supplier) 60 configured to supply an external voltage to the display device 100, and a sensor driver 70 configured to detect degradation information of the pixel circuit.

Each of the plurality of pixels may be coupled to one scan line of a plurality of scan lines S0 to Sn in the display panel 10.

Further, each of the plurality of pixels may be coupled to one data line among a plurality of data lines D1 to Dm configured to transmit data signals to the display panel 10, and one selection signal line among a plurality of selection signal lines SEL0 to SELn configured to transmit selection signals to the display panel 10.

The display panel 10 may be driven by a digital driving method. The digital driving method may adjust an emission time of each pixel according to data signals so as to display gray levels. A pixel may emit light by a first power supply ELVDD and a second power supply ELVSS that are applied thereto and the emission time may be adjustable to data signals, such that gray levels may be displayed. In this case, luminance may change according to voltage values of the first power supply ELVDD and second power supply ELVSS applied to the pixel even though the same gray level is displayed.

The display panel 10 may be an organic light emitting panel that is operated by the first power supply ELVDD and the second power supply ELVSS. Pixels included in the organic light emitting panel may include organic light emitting diodes (OLEDs), respectively. The OLED may be applied with the first power supply ELVDD and the second power supply ELVSS, and then a current may flow through the OLED such that light may be emitted. However, the display panel 10 may also be any one of many different types of panels that include a self-emissive device.

The control unit 50 may be configured to control the scan driver 20, the data driver 30, the selector driver 40, the power supply unit 60, and the sensor driver 70. The control unit 50 may generate signals to control the scan driver 20, the data driver 30, the selector driver 40, the power supply unit 60, and the sensor driver 70, based on image data DATA and a control signal CS that are received from the outside, and may transmit the generated signals to the scan driver 20, the data driver 30, the selector driver 40, the power supply unit 60, and the sensor driver 70. For instance, the control signal CS may be a time signal such as a vertical synchronous signal (Vsync), a horizontal synchronous signal (Hsync), a clock signal (CLK), and a data enable (DE) signal, and the image data DATA may be a digital signal that represents gray levels of light output from a pixel 80.

The scan driver 20 may receive a scan control signal SCS from the control unit 50 so as to generate a scan signal. The scan driver 20 may transmit the generated scan signal to each pixel through the plurality of scan lines S0 to Sn. Each pixel row may be sequentially selected based on the scan signal so that a data signal may be provided.

The data driver 30 may receive a data control signal DCS from the control unit 50 so as to transmit a data signal to each pixel through the plurality of data lines D1 to Dm.

The selector driver 40 may receive a selection control signal SELCS from the control unit 50 so as to transmit a selection signal to each pixel through the plurality of selection signal lines SEL0 to SELn. The selector driver 40 may also apply a third power supply RST to each pixel. The third power supply RST may be a variable voltage. For example, the third power supply RST may be changed to a low level voltage or a high level voltage.

The power supply unit 60 may generate a first power supply ELVDD, a second power supply ELVSS, a fourth power supply VSS, and a fifth power supply VSH that may be applied to the display panel 10. The first power supply ELVDD and the second power supply ELVSS may be applied to a plurality of pixels of the display panel 10 in common (or concurrently) such that each pixel may emit light. A current flowing in each pixel when light is emitted may be determined by voltages of the first power supply ELVDD and the second power supply ELVSS. When a current flowing in a pixel, namely a drive current, varies in a current value when the pixel emits light, luminance may also change even though the same gray level is displayed. The first power supply ELVDD may be driving power and the second power supply ELVSS may be ground power.

The sensor driver 70 may receive a sensor control signal SENCS from the control unit 50 so as to detect degradation information of each pixel. The degradation information of each pixel may be obtained from comparisons of voltages transmitted from a sensing unit of a pixel circuit. The sensor driver 70 may transmit a control signal for changing a data signal applied to each pixel, in accordance with the degradation information of each pixel, to the data driver 30. The sensor driver 70 may also transmit the control signal for changing a data signal to the control unit 50 and the control unit 50 may transmit a changed data control signal to the data driver 30.

The display panel 10 may include a plurality of pixels, and the pixels may be at respective crossings of the plurality of scan lines S0 to Sn, the plurality of data lines D1 to Dm, and the plurality of selection signal lines SEL0 to SELn.

Referring to FIG. 1, one pixel 80 among a plurality of pixels included in the $n^{th}$ pixel line may be coupled to the scan line Sn corresponding to the $n^{th}$ pixel line and the selection signal line SELn corresponding to the $n^{th}$ pixel line.

The pixel 80 may receive the scan signal through the scan line Sn, and concurrently may receive the selection signal through the selection signal line SELn.

The plurality of pixels may be supplied or applied with external voltages such as the first power supply ELVDD, the second power supply ELVSS, the fourth power supply VSS, and the fifth power supply VSH from the power supply unit 60. The first power supply ELVDD may have a higher voltage level than that of the second power supply ELVSS. The fourth power supply VSS may be a ground voltage. The fifth power supply VSH may be an initialization voltage for initializing a voltage of a first electrode of a third transistor of a pixel.

The display panel 10 may include a plurality of pixels substantially arranged in a matrix form. Although not particularly limited, the plurality of scan lines S0 to Sn may extend generally in a row direction in the pixel arrangement so as to be substantially parallel to each other, and the plurality of data lines D1 to Dm may extend generally in a column direction so as to be substantially parallel to each other in the arrangement of the pixels.

Each of the plurality of pixels may emit light having a set luminance (e.g., a predetermined luminance) by a driving current applied to an organic light emitting diode (OLED) according to a corresponding data signal transmitted through the plurality of data lines D1 to Dm.

Hereinafter, according to an embodiment of the present invention, a circuit configuration of the pixel 80 of the display device 100 will be described in detail with reference to FIG. 2.

Figure 2:
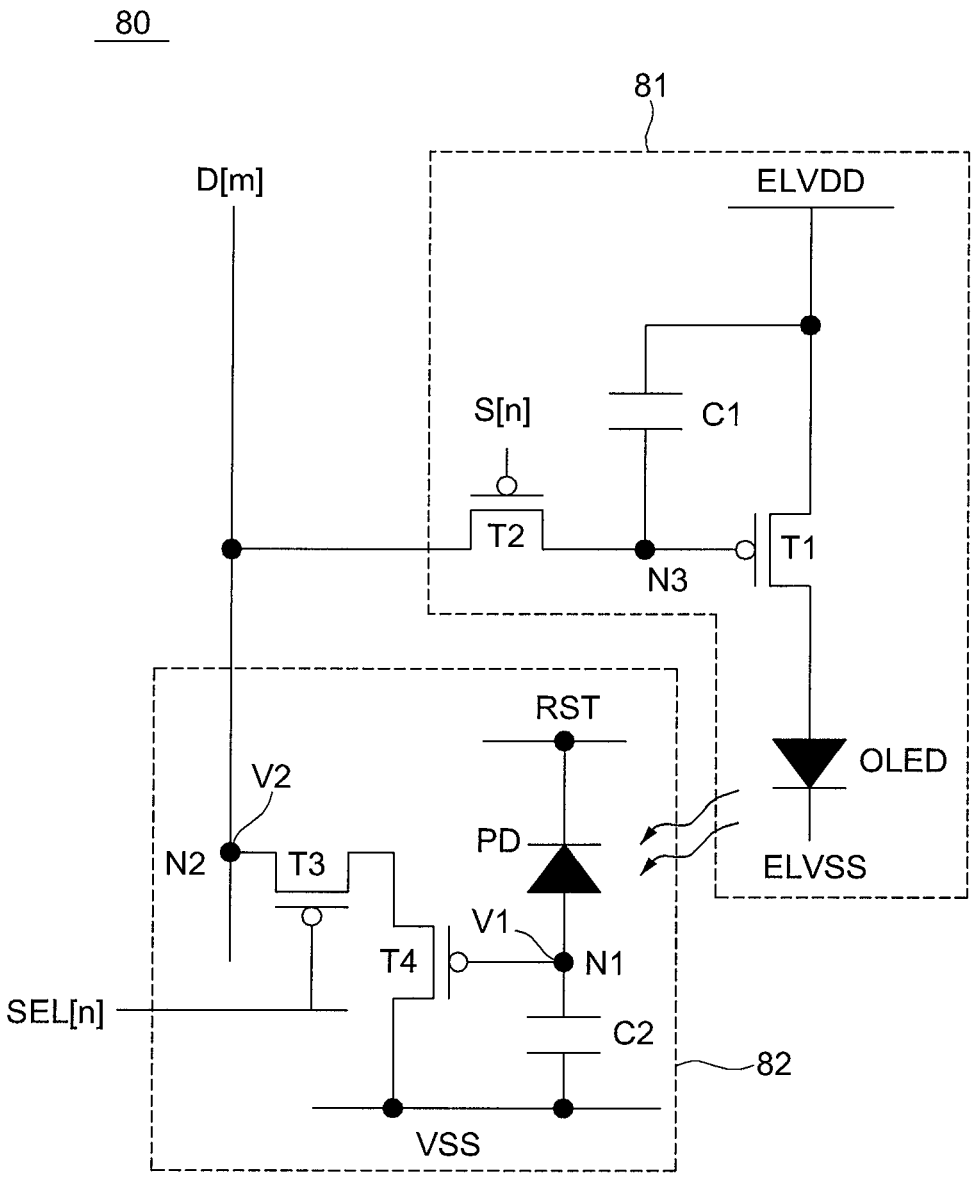
FIG. 2 is a circuit diagram illustrating a pixel circuit configuration of the display device shown in FIG. 1.

FIG. 2 is a circuit diagram illustrating a pixel circuit configuration of the display device shown in FIG. 1.

Referring to FIG. 2, the pixel 80 may be coupled to the $n^{th}$ scan line Sn and the $n^{th}$ selection signal line SELn among the plurality of pixels included in the display panel 10 of the display device 100 illustrated in FIG. 1. Also, the pixel 80 may be coupled to the $m^{th}$ data line Dm.

Each transistor may include a gate electrode, a first electrode, and a second electrode. The first electrode may be a source electrode, and the second electrode may be a drain electrode. Each transistor will be described below as a p-type transistor, but embodiments of the present invention are not limited thereto. Each transistor may also be an n-type transistor.

The pixel 80 shown in FIG. 2 may include a pixel portion 81 and a sensing unit (or sensor) 82.

The pixel portion 81 may include an organic light emitting diode (OLED), a first transistor T1, a second transistor T2, and a first capacitor C1.

The sensing unit 82 may include a third transistor T3, a fourth transistor T4, a light receiving element PD, and a second capacitor C2.

In FIG. 2, each of the first transistor T1 through the fourth transistor T4 may be shown as a p-type transistor, but may also be an n-type transistor in other embodiments.

The first transistor T1 may include a gate electrode coupled to a third node N3, a second electrode coupled to the OLED, and a first electrode coupled to the first power supply ELVDD.

The first transistor T1 may generate a driving current of a data voltage according to a data signal D[m] applied to the first transistor T1 through the $m^{th}$ data line Dm and the second transistor T2, and may transmit the driving current to the OLED through the second electrode. The driving current may be a current corresponding to a voltage difference between the first electrode and the gate electrode of the first transistor T1, and it may change in response to the data voltage corresponding to the data signal applied to the gate electrode.

The second transistor T2 may include a gate electrode coupled to the $n^{th}$ scan line Sn, a first electrode coupled to the $m^{th}$ data line Dm, and a second electrode coupled to the third node N3 to which a first capacitor C1 electrode and the gate electrode of the first transistor T1 are coupled in common.

The second transistor T2 may activate driving of the pixel 80 in response to the corresponding scan signal S[n] transmitted through the $n^{th}$ scan line Sn. In other words, the second transistor T2 may transmit the data voltage corresponding to the data signal D[m] transmitted through the $m^{th}$ data line Dm to the third node N3 in response to the scan signal S[n].

The first capacitor C1 may include one electrode coupled to the third node N3 and the other electrode coupled to a supply line of the first power supply ELVDD. As described above, the first capacitor C1 may be coupled between the gate electrode of the first transistor T1 and the supply line of the first power supply ELVDD, and thus it may maintain the voltage applied to the gate electrode of the first transistor T1.

The third transistor T3 may include a gate electrode coupled to the $n^{th}$ selection signal line SELn, a first electrode coupled to the $m^{th}$ data line Dm, and a second electrode coupled to a first electrode of the fourth transistor T4.

The third transistor T3 may operate in response to the selection signal SEL[n] transmitted through the $n^{th}$ selection signal line SELn. The third transistor T3 may act as a switching element.

The fourth transistor T4 may include a gate electrode coupled to a first node N1, a second electrode coupled to the fourth power supply VSS, and a first electrode coupled to the second electrode of the third transistor T3.

The light receiving element PD may be coupled between the third power supply RST and the second capacitor C2 and may flow a current corresponding to light conversion in response to the light conversion into the second capacitor C2. Thus, the second capacitor C2 may be charged to a desired voltage (e.g., a predetermined voltage).

In other words, an anode of the light receiving element PD may be coupled to one electrode of the second capacitor C2 and a cathode may be coupled to the third power supply RST. The light receiving element PD may be any one of a PIN diode, a PN diode, a photocoupler, and equivalents, but embodiments of the present invention are not limited regarding the kinds or materials of the light receiving element PD.

One electrode of the second capacitor C2 may be coupled to the anode of the light receiving element PD and a gate electrode of the fourth transistor T4 and the other electrode may be coupled to the fourth power supply, and the second capacitor C2 may serve to store a voltage applied to the gate electrode of the fourth transistor T4.

In this case, the fourth power supply may apply a low level voltage and may be realized as a ground voltage (GND).

Figure 3:
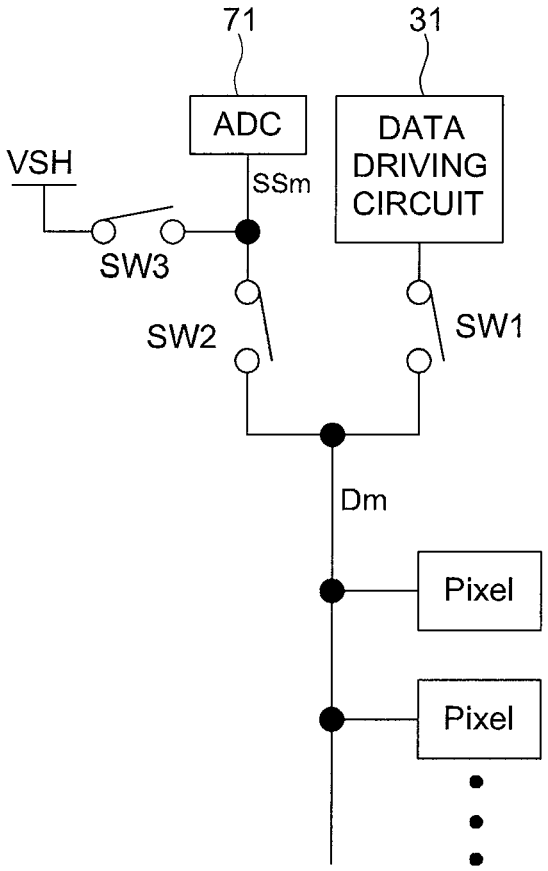
FIG. 3 is a schematic block diagram illustrating a sensor driver, and a switch between a data driver and a data line shown in FIG. 1.

The data driver 30 and the sensor driver 70 structured to be coupled to the data line Dm will be described below with reference to FIGS. 2 and 3.

The sensor driver 70 may include an analog-to-digital converter (ADC) 71. The ADC may convert a voltage transmitted from the sensing unit 82 of a pixel to a digital value.

The data driver 30 may include a data driving circuit 31 configured to transmit data signals.

A first switch SW1 may be coupled between the data driving circuit 31 and the data line Dm. A second switch SW2 may be coupled between an output signal line SSm for connection to the ADC and the data line Dm. A third switch SW3 may be coupled between the fifth power supply VSH and the second switch SW2.

The first to third switches may act as a switch that alternately couples a plurality of data lines D0 to Dm and a plurality of output signal lines SS0 to SSm, respectively.

The sensor driver 70 may detect information using the data line Dm in a similar way to the data driver 30. That is, the sensor driver 70 may detect information utilizing the conventional data line Dm.

The plurality of output signal lines SS0 to SSm may allow the sensor driver 70 to have the data line Dm in common with the data driver 30.

For example, the first and second switches SW1 and SW2 may be configured such that the sensor driver 70 and the data driver 30 can have the conventional data line Dm in common. When the first switch SW1 may be turned on and the second switch SW2 may be turned off, the data driver 30 may use the data line Dm in the same way as in the related art. When the first switch SW1 may be turned off and the second switch SW2 may be turned on, the plurality of output signal lines SS0 to SSm may be coupled to the data line Dm, and thus the sensor driver 70 may utilize the data line Dm.

The sensor driver 70 may further include a switching controller configured to control switching operations of the first to third switches. The control unit 50 may, of course, control the switching operations of the first to third switches.

The fifth power supply VSH may apply an initialization voltage for initializing a voltage of the gate electrode of the fourth transistor T4 of the sensing unit 82. In other words, the fifth power supply VSH may apply the initialization voltage to the first electrode of the third transistor T3 through the data line Dm. The fifth power supply VSH may apply a high level voltage.

For ease of description, in the present embodiment, a voltage of the third power supply RST is represented by Vrst, a threshold voltage of the light receiving element PD is represented by Vpd, a threshold voltage of the fourth transistor T4 is represented by Vt4, a voltage of the first node N1 is represented by V1, a voltage of the second node N2 is represented by V2, and a voltage increase of the first node N1 due to a current flowing in the light receiving element PD during a light emission period is represented by ΔV.

Figure 4:
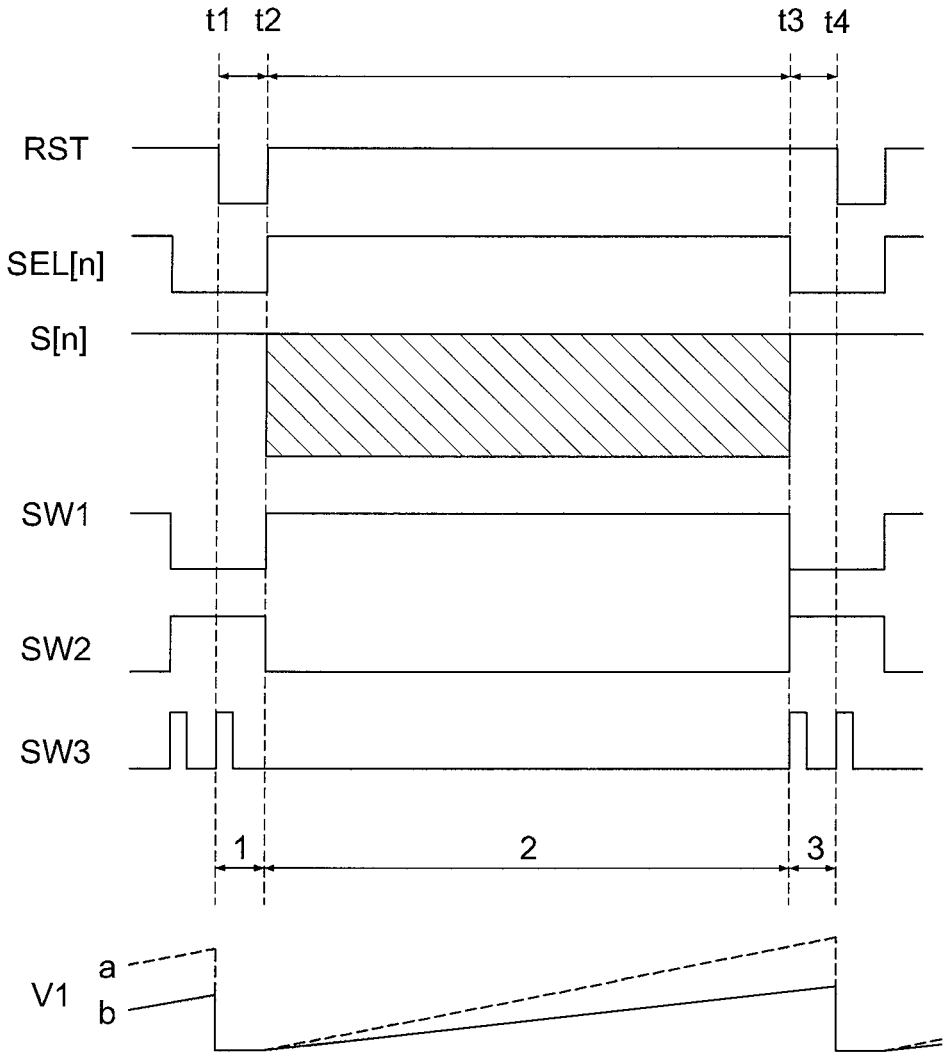
FIG. 4 is a timing diagram illustrating a driving operation of the pixel shown in FIG. 2 during one frame.

Hereinafter, a timing diagram shown in FIG. 4 showing a driving operation of a pixel will be described in detail.

FIG. 4 is a timing diagram illustrating a driving operation of the pixel shown in FIG. 2 during one frame.

One frame may be divided into three periods (1, 2, and 3) and an operation to detect degradation of one pixel will be described below.

The first period 1 may be a period to initialize a first electrode voltage of the third transistor T3. That is, the first electrode voltage of the third transistor T3, which is applied to the data line Dm, may be initialized and the second node voltage V2 may be detected.

The second period 2 may be a period to emit light by the OLED.

The third period 3 may be a period to detect the second node voltage V2 reflecting a varying voltage by sensing the light emitted from the OLED by the light receiving element.

The third power supply RST may be a variable voltage and a low level voltage may be applied to a cathode of the light receiving element PD during the first period 1.

The selection signal SELn may be a voltage (e.g., set as a voltage or set as a low level voltage) that can turn on the third transistor T3 illustrated in FIG. 2 during the first and third periods 1 and 3.

The scan signal Sn may be set as a high level voltage during the first and third periods 1 and 3. That is, the second transistor T2 may be turned off during the first and third periods 1 and 3. The scan signal Sn may be applied to each pixel in accordance with a general digital driving method during the second period 2 so as to allow the OLED to be turned on or off.

The first switch SW1 may be turned off during the first and third periods 1 and 3. That is, the data driver 30 illustrated in FIG. 1 and the data line Dm may be disconnected from each other. The first switch SW1 may be turned on during the second period 2 and the data driver 30 illustrated in FIG. 1 and the data line Dm may be coupled to each other.

The second switch SW2 may be turned on during the first and third periods 1 and 3. That is, the ADC 71 illustrated in FIG. 3 and the data line Dm may be coupled to each other. The second switch SW2 may be turned off during the second period 2 and the ADC 71 illustrated in FIG. 3 and the data line Dm may be disconnected from each other.

The third switch SW3 may be momentarily turned on at the start of the first and third periods 1 and 3 and then may be turned off. That is, the third switch SW3 may apply a fifth power supply VSH voltage to the third transistor T3 for a short time during the first and third periods 1 and 3. The fifth power supply VSH may be an initialization power supply and may be a suitably (or sufficiently) high level voltage.

V1 shown in the timing diagram of FIG. 4 is the voltage of the first node N1. In other words, V1 may increase as the OLED emit lights during the second period 2. The reason the voltage increases is that photo-leakage current flows in the light receiving element PD as described above. The photo-leakage current may be relatively high when light incident on the light receiving element PD is bright, and in contrast, the photo-leakage current may be relatively low when the light incident on the light receiving element PD is not bright. Accordingly, a graph showing a large V1 voltage rise, as in the "a" graph shown in FIG. 4, corresponds to the case where light with high intensity is incident upon the light receiving element PD. In contrast, a graph showing a small V1 voltage rise, as in the "b" graph shown in FIG. 4, corresponds to the case where light with low intensity is incident upon the light receiving element PD.

An operation process of a pixel driven by the driving signals shown in FIG. 4 will be described below in detail with reference to FIGS. 5A, 5B, and 5C.

Figure 5A:
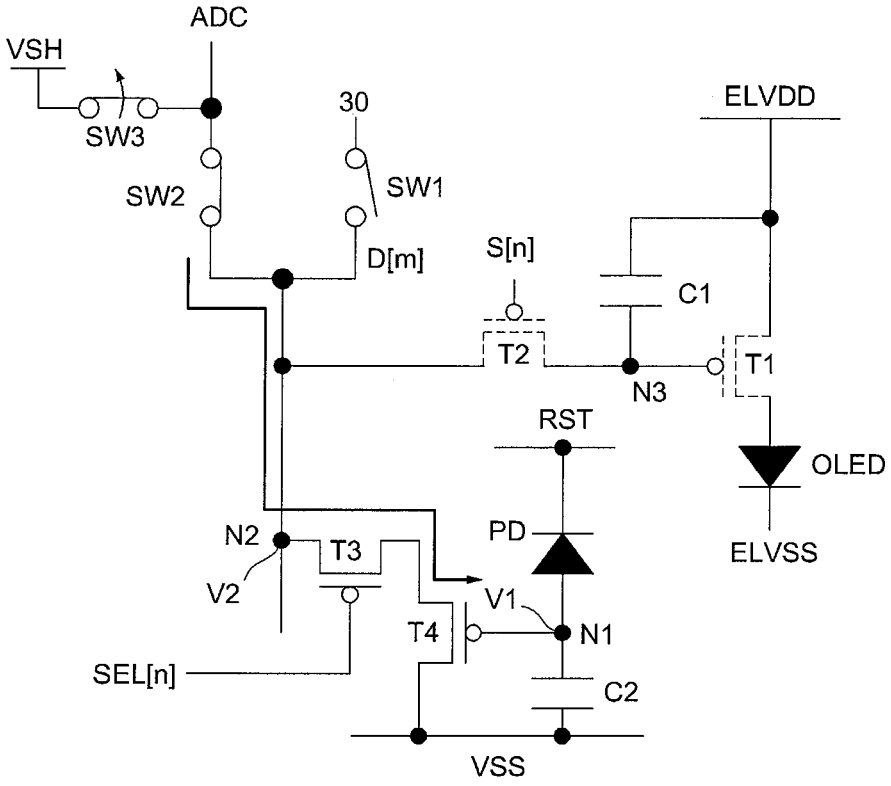
FIGS. 5A, 5B, and 5C are circuit diagrams and timing diagrams sequentially illustrating a driving method of the pixel shown in FIG. 2 driven according to the timing diagram shown in FIG. 4.
Figure 5A:
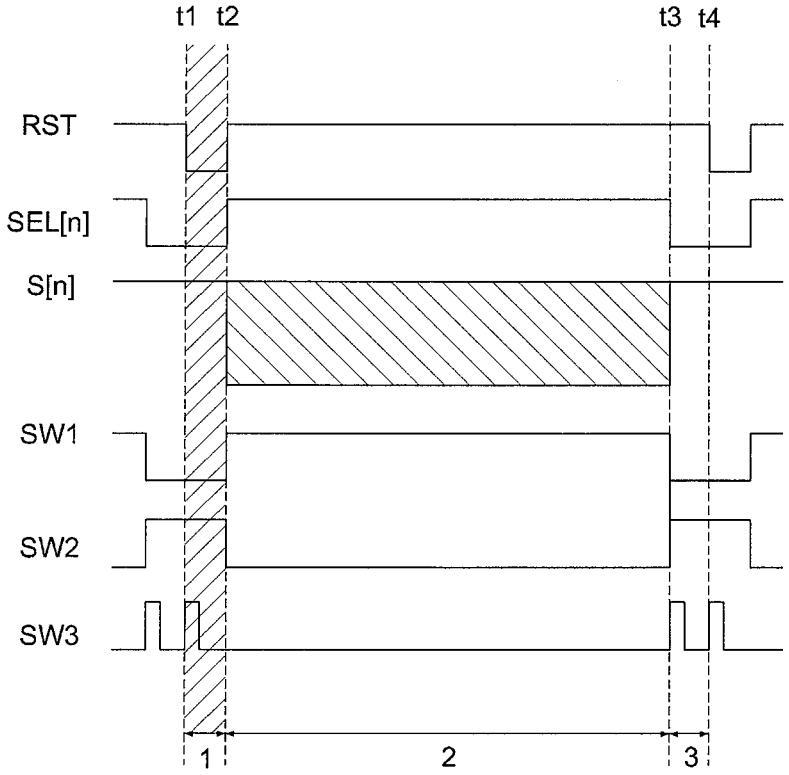
Figure 5B:
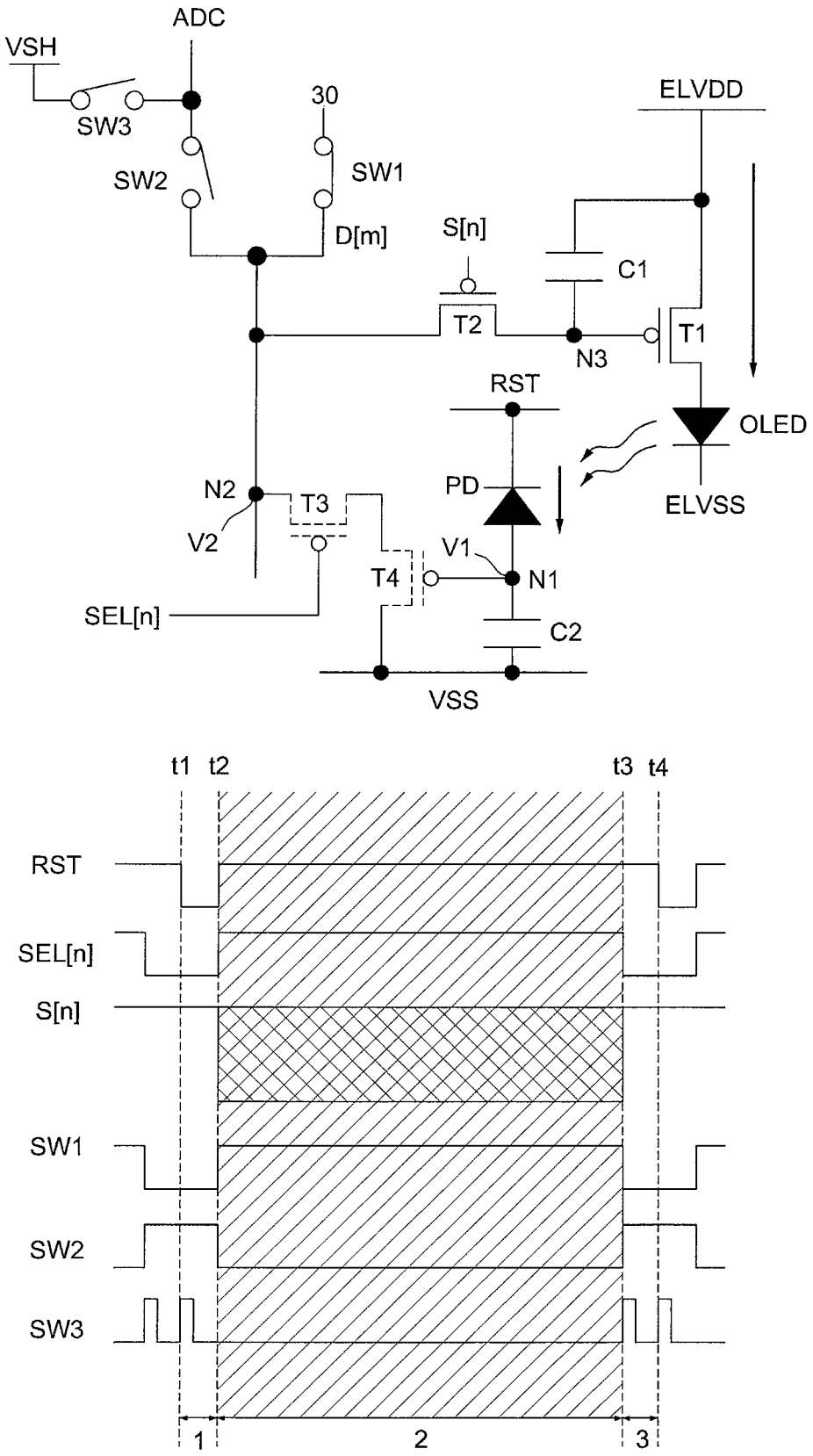
Figure 5C:
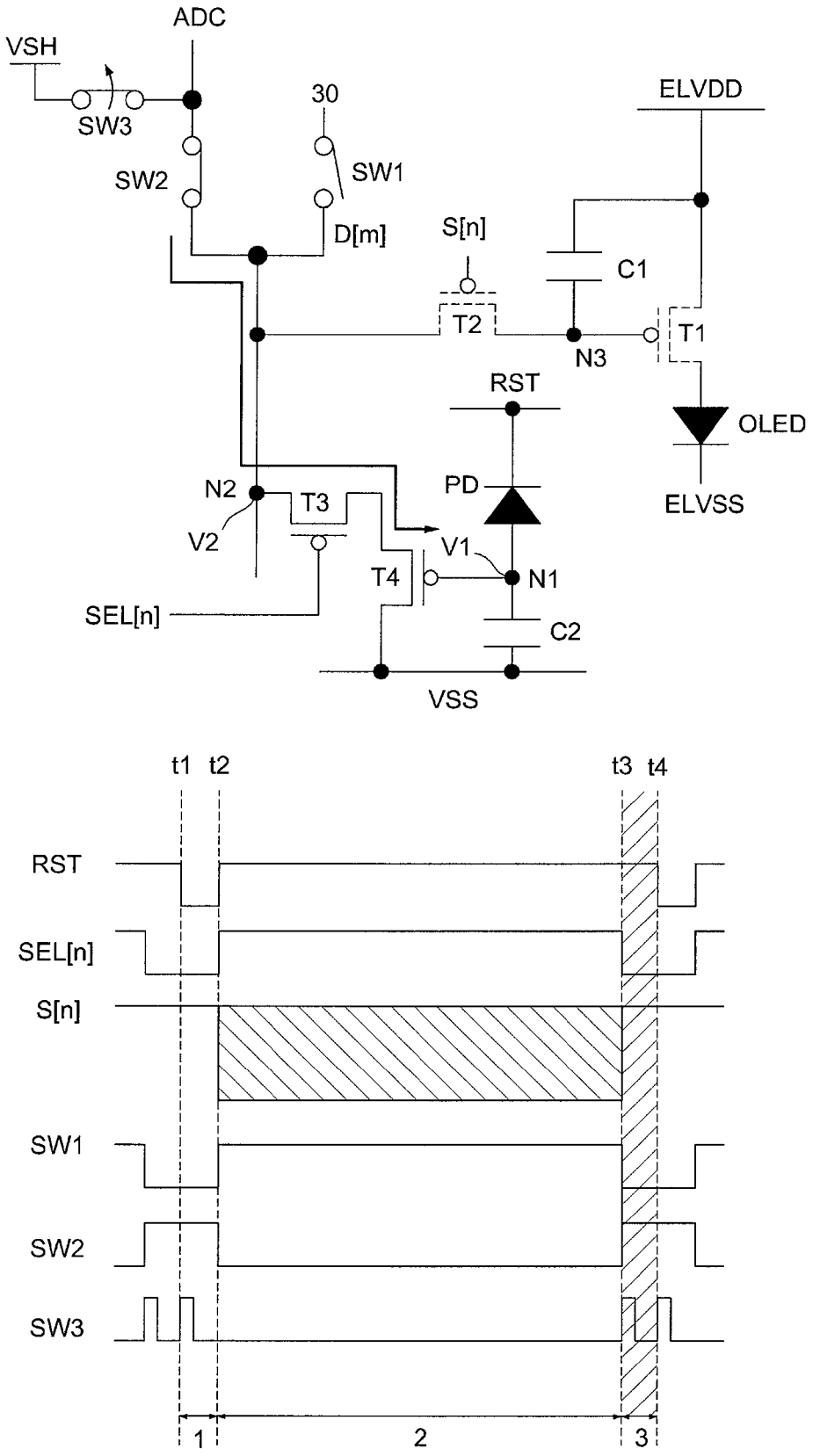

FIGS. 5A, 5B, and 5C are circuit diagrams and timing diagrams sequentially illustrating a driving method of the pixel shown in FIG. 2 driven according to the timing diagram shown in FIG. 4.

FIG. 5A is a diagram illustrating a pixel circuit operation during the first period 1.

Referring to FIG. 5A, a low level voltage may be applied to the third power supply RST, the selection signal SEL[n] having a low level voltage may be transmitted to the selection signal line SELn, the scan signal S[n] having a high level voltage may be transmitted to the scan line Sn, the first switch SW1 may be turned on, the second switch SW2 may be turned on, and the third switch SW3 may be momentarily turned on and then may be turned off.

During the first period 1, the third power supply voltage Vrst of a low level may be applied to the cathode of the light receiving element PD. When the low level voltage is applied to the cathode of the light receiving element PD, the light receiving element PD may operate in forward bias. In the case of the forward bias, a current may flow in a direction of the third power supply RST and the light receiving element PD may be discharged. Therefore, the voltage V1 of the first node N1 may be the sum of the voltage Vrst of the third power supply RST and the threshold voltage Vpd of the light receiving element PD. That is, the voltage Vrst+Vpd may be applied to the first node N1.

The second capacitor C2 may be charged to Vrst+Vpd.

During the first period 1, when the selection signal having a low level voltage is transmitted to the selection signal line SELn, the third transistor T3 may be turned on.

During the first period 1, when the scan signal having a high level voltage is transmitted to the scan line Sn, the second transistor T2 may be turned off and the OLED may not emit light.

The first switch SW1 may be turned off and the data line Dm and the data driver 30 may be disconnected from each other. The second switch SW2 may be turned on and the data line Dm and the ADC may be coupled to each other.

The third switch SW3 may be momentarily turned on at the point of time t1 of the first period 1 and then may be turned off. Thereafter, the fifth power supply VSH and the data line Dm may be coupled to each other and a suitably (or sufficiently) high voltage may be applied to the first electrode of the third transistor T3. The third switch SW3 may be turned off after being turned on, and thus a current may flow through the third and fourth transistors T3 and T4, a voltage may decrease, and consequently the second node voltage V2 may be Vrst+Vpd+|Vt4|. |Vt4| denotes the threshold voltage of the fourth transistor T4 as previously described.

The ADC coupled to the data line Dm may receive a value of the second node voltage V2 and may store a digital value to which the value of the second node voltage V2 is converted. The digital value stored in the ADC may be an initial voltage value and the initial voltage value is called Va.

In other words, the first period 1 may be a reset period and a voltage of the first electrode of the third transistor T3 may be measured during the first period 1 before the OLED emits light. Therefore, when the second node voltage V2 that is the first electrode voltage of the third transistor T3 is remeasured during the third period 3, a voltage variation during the second period 2 can be noticed.

FIG. 5B is a diagram illustrating a pixel circuit operation during the second period 2.

Referring to FIG. 5B, a high level voltage may be applied to the third power supply RST, the selection signal SEL[n] having a high level voltage may be transmitted to the selection signal line SELn, the scan signal S[n] having a high or low level voltage may be transmitted to the scan line Sn, the first switch SW1 may be turned on, the second switch SW2 may be turned off, and the third switch SW3 may be turned off.

During the second period 2, the third power supply voltage Vrst of a high level may be applied to the cathode of the light receiving element PD. When the high level voltage is applied to the cathode of the light receiving element PD, the light receiving element PD may be reverse-biased.

During the second period 2, when the selection signal having a high level voltage is transmitted to the selection signal line SELn, the third transistor T3 may be turned off.

During the second period 2, when the scan signal having a high or low level voltage is transmitted to the scan line Sn, the second transistor T2 of each pixel may be turned on or off and the OLED may emit light. For instance, the low level voltage may be transmitted to the scan line Sn so that the second transistor T2 may be turned on and a drive current may flow from the first power supply ELVDD to the second power supply ELVSS via the first transistor T1 and the OLED.

The second period 2 may be a general emission period of the OLED and a display panel may be driven by the digital driving method. Each pixel may display gray levels by adjusting an emission time of each pixel in accordance with data signals. The OLED may emit light with luminance corresponding to the data signals during the second period 2.

The first switch SW1 may be turned on such that the data line Dm and the data driver 30 may be coupled to each other. The second switch SW2 may be turned off such that the data line Dm and the ADC may be disconnected from each other. The third switch SW3 may be turned off such that the fifth power supply VSH and the data line Dm may be disconnected from each other.

The light receiving element PD may operate in reverse bias and the OLED may emit light, and thus the light receiving element PD may allow photo-leakage current to flow in a direction of the second capacitor C2. That is, the light receiving element PD may allow the photo-leakage current generated according to intensity of incident light to flow to one electrode of the second capacitor C2. Therefore, the second capacitor C2 may be charged up to the extent corresponding to the photo-leakage current. In other words, the first node voltage V1 may increase. The increase of the first node voltage V1 may correspond to the amount of the photo-leakage current. The photo-leakage current may be relatively high when intensity of incident light is high, and in contrast the photo-leakage current may be relatively low when intensity of incident light is low.

Hereinafter, the increase of the first node voltage V1 according to the photo-leakage current will be called a voltage variation ΔV.

Due to the photo-leakage current of the second period 2, the second capacitor C2 may be charged to Vrst+Vpd+ΔV. That is, the first node voltage V1 may be Vrst+Vpd+ΔV.

FIG. 5C is a diagram illustrating a pixel circuit operation during the third period 3.

Referring to FIG. 5C, a high level voltage may be applied to the third power supply RST, the selection signal SEL[n] having a low level voltage may be transmitted to the selection signal line SELn, the scan signal S[n] having a high level voltage may be transmitted to the scan line Sn, the first switch SW1 may be turned off, the second switch SW2 may be turned on, and the third switch SW3 may be momentarily turned on and then may be turned off.

During the third period 3, the third power supply voltage Vrst of a high level may be applied to the cathode of the light receiving element PD. When the high level voltage is applied to the cathode of the light receiving element PD, the light receiving element PD may operate in reverse bias.

During the third period 3, when the selection signal having a low level voltage is transmitted to the selection signal line SELn, the third transistor T3 may be turned on.

During the third period 3, when the scan signal having a high level voltage is transmitted to the scan line Sn, the second transistor T2 may be turned off and the OLED may not emit light.

The first switch SW1 may be turned off such that the data line Dm and the data driver 30 may be disconnected from each other. The second switch SW2 may be turned on such that the data line Dm and the ADC may be coupled to each other.

The third switch SW3 may be momentarily turned on at the point of time t3 of the third period 3 and then may be turned off. Thereafter, the fifth power supply VSH and the data line Dm may be coupled to each other and a suitably (or sufficiently) high voltage may be applied to the first electrode of the third transistor T3. The third switch SW3 may be turned off after being turned on, and thus a current may flow through the third and fourth transistors T3 and T4, a voltage may decrease, and consequently the second node voltage V2 may be Vrst+Vpd+|Vt4|+ΔV. ΔV denotes a voltage variation according to the photo-leakage current as previously described.

The ADC coupled to the data line Dm may receive a value of the second node voltage V2 and may store a digital value to which the value of the second node voltage V2 is converted. The digital value stored in the ADC may be a detected voltage value and the detected voltage value is called Vb.

In other words, the third period 3 may be a detection period and a voltage of the first electrode of the third transistor T3 may be measured during the third period 3 after the OLED emits light. Therefore, the voltage variation ΔV can be obtained by comparing the detected voltage value stored in the ADC during the third period 3 and the initial voltage value stored in the ADC during the first period 1. In other words, the voltage variation ΔV may be Vb−Va.

The voltage variation ΔV corresponding to information of pixel degradation resulting from light emission of the OLED may be obtained through the first to third periods. The pixel degradation relates to luminance of the OLED and the luminance of the OLED relates to light intensity. Accordingly, if during an emission period of the OLED, the photo-leakage current flowing in the light receiving element PD and the voltage variation according to the photo-leakage current can be obtained, it may be possible to know which pixel is degraded among a plurality of pixels.

What pixel is degraded among a plurality of pixels can be determined by the following method using ΔV. The sensor driver may be configured to analyze the degradation information of a pixel and transmit a corrected data signal to a degraded pixel.

According to one embodiment, an organic light emitting diode display may include n number of pixels (where n is a natural number).

First, ΔV may be divided by an emission time of each pixel, thereby obtaining a comparison value L. In the digital driving method, the emission time may correspond to gray level data that is displayed by each pixel. For instance, when the emission time is 100%, the brightest white gray level may be displayed, and when the emission time is 1%, the darkest black gray level may be displayed.

When the emission time of the $n^{th}$ pixel is 80% of the second period 2, which is an emission period, in one frame, the comparison value L of the $n^{th}$ pixel may be ΔV/0.8. That is, the comparison value L may be ΔV of a corresponding pixel/the emission time of the corresponding pixel.

In the case where the comparison values L of each pixel are obtained, the comparison values L should be consistent with each other if all pixels are not degraded. This is because ΔV relates to light intensity of the OLED per pixel and the light intensity is proportional to the emission time.

When ΔV of the $n^{th}$ pixel is ΔVn and the emission time of the $n^{th}$ pixel is Tn, ΔV1/T1=ΔV2/T2 . . . =ΔVn/Tn should be valid.

In other words, when each pixel is not degraded and emits light according to applied data signals, the comparison values L of all pixels should be consistent with each other.

However, when a voltage variation in a pixel is large as in the "a" graph of V1 shown in FIG. 4 or small as in the "b" graph of V1 shown in FIG. 4, the comparison value L of the pixel may be larger or smaller than the comparison values L of other pixels.

Therefore, a pixel of which the comparison value L is not consistent with the comparison values L of other pixels may receive a corrected data signal so as to have the same comparison value L. That is, the emission time of a degraded pixel may be adjusted such that the degraded pixel may be corrected to display a gray level that should have been originally emitted.

For instance, a pixel that has a different comparison value L from those of other pixels because the pixel has a high value of ΔV may receive a corrected data signal so as to be provided with a more decreased emission time than the originally applied emission time.

Thus, by using a pixel circuit and a driving method utilizing the pixel circuit, ΔV may be sensed, a degraded pixel may be detected, and a corrected data signal may be transmitted to the detected pixel, thereby compensating for luminance deviation by the pixel degradation.

Hereinafter, according to another embodiment of the present invention, a display device will be described with reference to FIGS. 6 and 7, and repeated descriptions of the same elements and/or configurations as those of the previous embodiments of the display device may not be provided.

Figure 6:
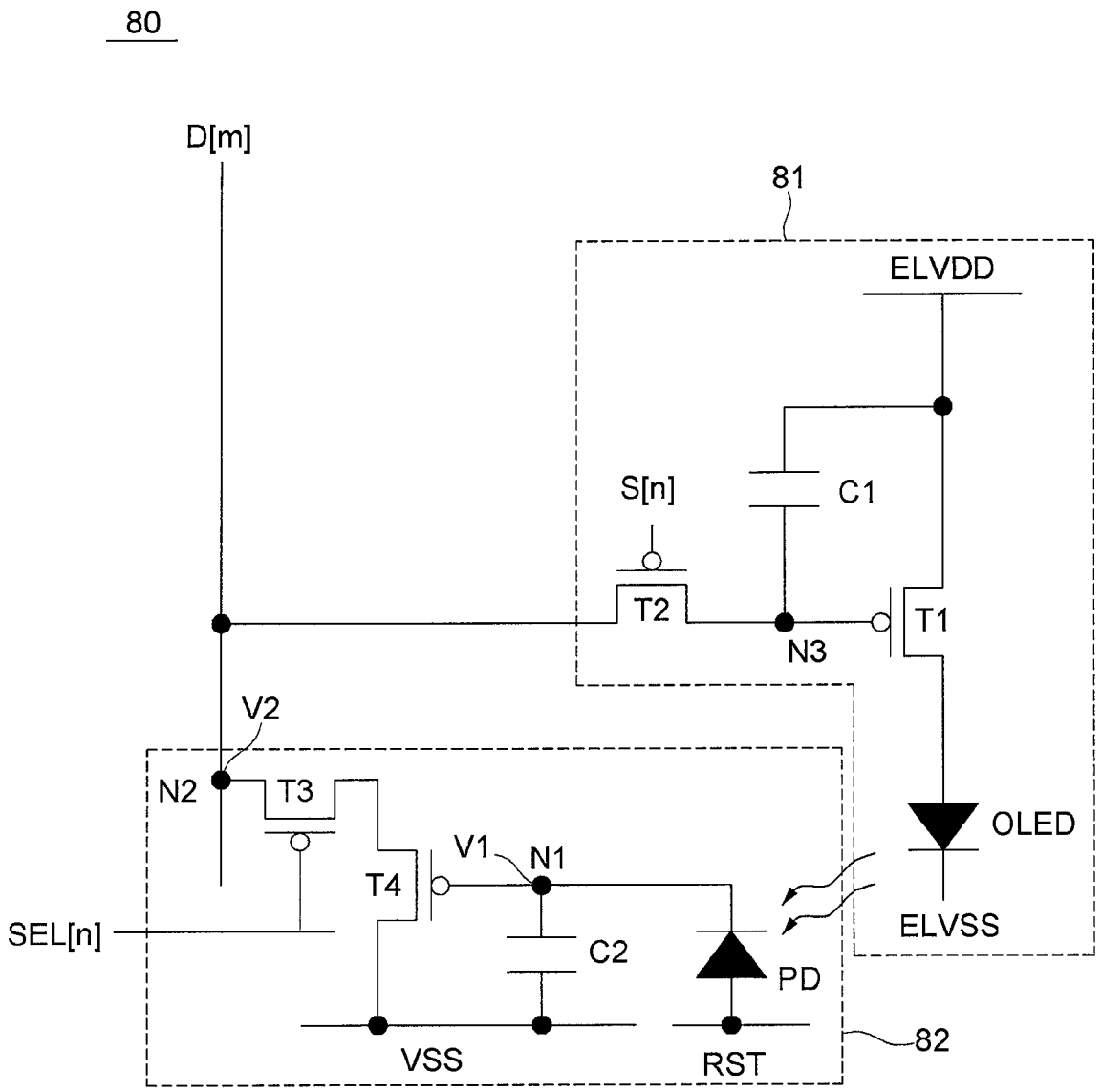
FIG. 6 is a circuit diagram illustrating a pixel circuit configuration of a display device according to another embodiment of the present invention.

FIG. 6 is a circuit diagram illustrating a pixel circuit configuration of a display device according to another embodiment of the present invention. FIG. 7 is a timing diagram illustrating a driving operation of the pixel shown in FIG. 6.

Referring to FIG. 6, a light receiving element PD may be coupled between a third power supply RST and a second capacitor C2 and may flow a current corresponding to light conversion in response to the light conversion into the second capacitor C2.

In other words, according to another embodiment, a cathode of the light receiving element PD may be coupled to one electrode of the second capacitor C2 and an anode may be coupled to the third power supply RST.

Figure 7:
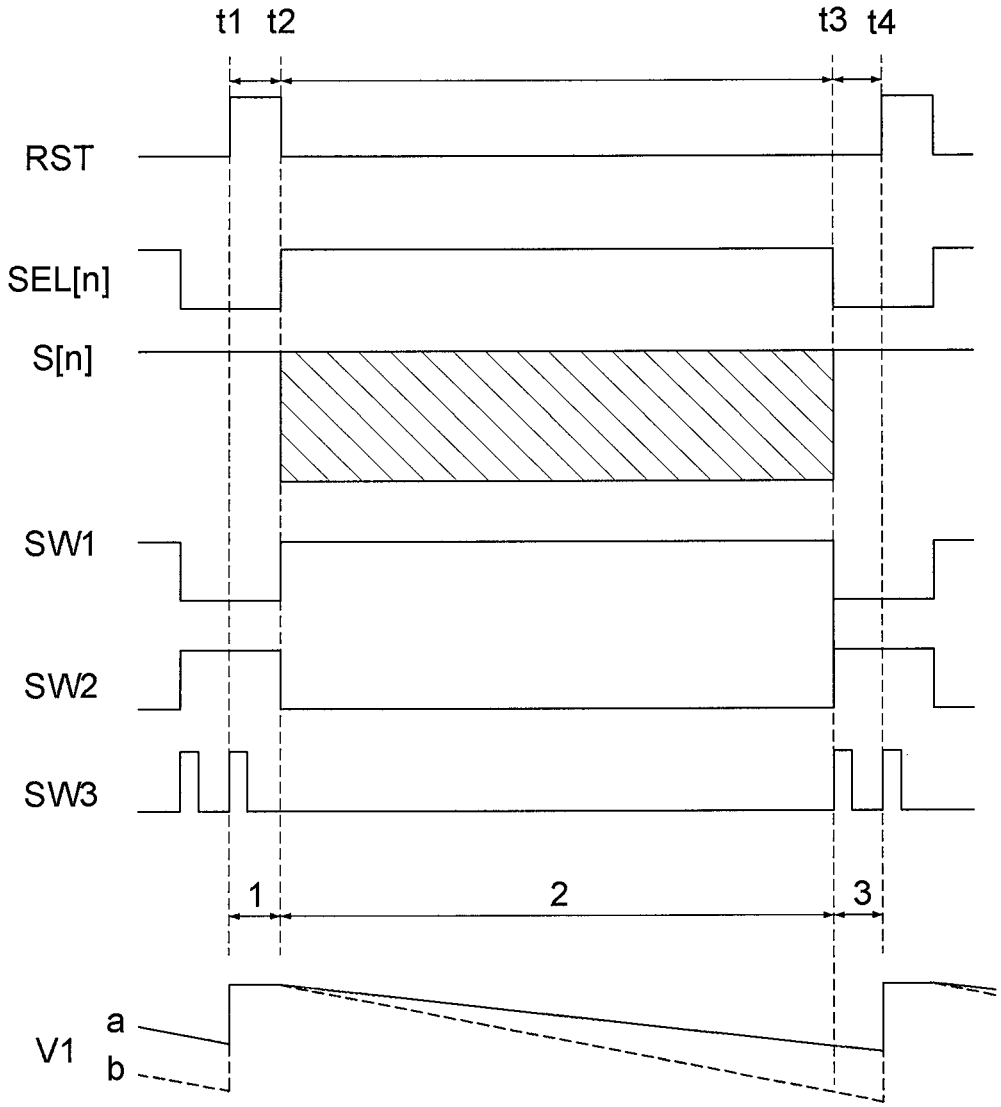
FIG. 7 is a timing diagram illustrating a driving operation of the pixel shown in FIG. 6.

Referring to FIG. 7, the light receiving element PD may be forward biased during first and third periods 1 and 3, and may be reverse biased during a second period 2. Therefore, when a voltage of the third power supply RST is suitably (or sufficiently) higher than a voltage of a first node N1, the light receiving element PD may be forward biased and the voltage V1 of the first node N1 may be Vrst-Vpd.

Operations according to another embodiment will be described below in detail.

According to another embodiment, a pixel circuit operation during the first period 1 will be as follows.

A high level voltage may be applied to a third power supply RST, a selection signal SEL[n] having a low level voltage may be transmitted to a selection signal line SELn, a scan signal S[n] having a high level voltage may be transmitted to a scan line Sn, a first switch SW1 may be turned off, a second switch SW2 may be turned on, and a third switch SW3 may be momentarily turned on and then may be turned off.

During the first period 1, a third power supply voltage Vrst of a high level may be applied to an anode of a light receiving element PD. When the high level voltage is applied to the anode of the light receiving element PD, the light receiving element PD may operate in forward bias. In the case of the forward bias, a current may flow in a direction of a first node N1 and the light receiving element PD may be charged. Therefore, a voltage V1 of the first node N1 may be the difference between the voltage Vrst of the third power supply RST and the threshold voltage Vpd of the light receiving element PD. That is, the Vrst−Vpd voltage may be applied to the first node N1.

A second capacitor C2 may be charged to Vrst−Vpd.

During the first period 1, when the selection signal having a low level voltage is transmitted to the selection signal line SELn, the third transistor T3 may be turned on.

During the first period 1, when the scan signal having a high level voltage is transmitted to the scan line Sn, the second transistor T2 may be turned off and the OLED may not emit light.

The first switch SW 1 may be turned off such that a data line Dm and a data driver 30 may be disconnected from each other. The second switch SW2 may be turned on such that the data line Dm and an ADC may be coupled to each other.

The third switch SW3 may be momentarily turned on at the point of time t1 of the first period 1 and then may be turned off. Thereafter, the fifth power supply VSH and the data line Dm may be coupled to each other and a suitably (or sufficiently) high voltage may be applied to the first electrode of the third transistor T3. The third switch SW3 may be turned off after being turned on, and thus a current may flow through the third and fourth transistors T3 and T4, a voltage may decrease, and consequently the second node voltage V2 may be Vrst−Vpd+|Vt4|. |Vt4| denotes the threshold voltage of the fourth transistor T4 as previously described.

The ADC coupled to the data line Dm may receive a value of the second node voltage V2 and may store a digital value to which the value of the second node voltage V2 is converted. The digital value stored in the ADC may be an initial voltage value and the initial voltage value is called Va.

In other words, the first period 1 may be a reset period and a voltage of the first electrode of the third transistor T3 may be measured in the first period 1 before the OLED emits light. Therefore, when the second node voltage V2 that is the first electrode voltage of the third transistor T3 is remeasured during the third period 3, a voltage variation during the second period 2 can be noticed.

According to another embodiment, a pixel circuit operation during the second period 2 will be as follows.

A low level voltage may be applied to the third power supply RST, the selection signal SEL[n] having a high level voltage may be transmitted to the selection signal line SELn, the scan signal S[n] having a high or low level voltage may be transmitted to the scan line Sn, the first switch SW1 may be turned on, the second switch SW2 may be turned off, and the third switch SW3 may be turned off.

During the second period 2, the third power supply voltage Vrst of a low level may be applied to the anode of the light receiving element PD. When the low level voltage is applied to the anode of the light receiving element PD, the light receiving element PD may be reverse biased.

During the second period 2, when the selection signal having a high level voltage is transmitted to the selection signal line SELn, the third transistor T3 may be turned off.

During the second period 2, when the scan signal having a high or low level voltage is transmitted to the scan line Sn, the second transistor T2 of each pixel may be turned on or off and the OLED may emit light. For instance, the low level voltage may be transmitted to the scan line Sn so that the second transistor T2 may be turned on and a drive current may flow from the first power supply ELVDD to the second power supply ELVSS via the first transistor T1 and the OLED.

The second period 2 may be a general emission period of the OLED and a display panel may be driven by the digital driving method. Each pixel may display gray levels by adjusting an emission time of each pixel in accordance with data signals. The OLED may emit light with luminance corresponding to the data signals during the second period 2.

The first switch SW1 may be turned on such that the data line Dm and the data driver 30 may be coupled to each other. The second switch SW2 may be turned off such that the data line Dm and the ADC may be disconnected from each other. The third switch SW3 may be turned off such that the fifth power supply VSH and the data line Dm may be disconnected from each other.

The light receiving element PD may operate in reverse bias and the OLED may emit light, and thus the photo-leakage current may flow in a direction of the third power supply RST by the light receiving element PD. That is, the light receiving element PD may allow the photo-leakage current generated according to intensity of incident light to flow in the direction of the third power supply RST. Therefore, the second capacitor C2 may be discharged up to the extent corresponding to the photo-leakage current. In other words, the first node voltage V1 may decrease. The decrease of the first node voltage V1 may correspond to the amount of the photo-leakage current. The photo-leakage current may be relatively high when the intensity of incident light is high, and in contrast the photo-leakage current may be relatively low when the intensity of incident light is low.

Hereinafter, the decrease of the first node voltage V1 according to the photo-leakage current will be called a voltage variation ΔV.

Due to the photo-leakage current of the second period 2, the second capacitor C2 may be charged to Vrst−Vpd−ΔV. That is, the first node voltage V1 may be Vrst−Vpd−ΔV.

According to another embodiment, a pixel circuit operation during the third period 3 will be as follows.

A low level voltage may be applied to the third power supply RST, the selection signal SEL[n] having a low level voltage may be transmitted to the selection signal line SELn, the scan signal S[n] having a high level voltage may be transmitted to the scan line Sn, the first switch SW1 may be turned off, the second switch SW2 may be turned on, and the third switch SW3 may be momentarily turned on and then may be turned off.

During the third period 3, the third power supply voltage Vrst of a low level may be applied to the anode of the light receiving element PD. When the low level voltage is applied to the anode of the light receiving element PD, the light receiving element PD may operate in reverse bias.

During the third period 3, when the selection signal having a low level voltage is transmitted to the selection signal line SELn, the third transistor T3 may be turned on.

During the third period 3, when the scan signal having a high level voltage is transmitted to the scan line Sn, the second transistor T2 may be turned off and the OLED may not emit light.

The first switch SW1 may be turned off such that the data line Dm and the data driver 30 may be disconnected from each other. The second switch SW2 may be turned on such that the data line Dm and the ADC may be coupled to each other.

The third switch SW3 may be momentarily turned on at the point of time t3 of the third period 3 and then may be turned off. Thereafter, the fifth power supply VSH and the data line Dm may be coupled to each other and a suitably (or sufficiently) high voltage may be applied to the first electrode of the third transistor T3. The third switch SW3 may be turned off after being turned on, and thus a current may flow through the third and fourth transistors T3 and T4, a voltage may decrease, and consequently the second node voltage V2 may be Vrst−Vpd+|Vt4|−ΔV. ΔV denotes a voltage variation according to the photo-leakage current as previously described.

The ADC coupled to the data line Dm may receive a value of the second node voltage V2 and may store a digital value to which the value of the second node voltage V2 is converted. The digital value stored in the ADC may be a detected voltage value and the detected voltage value is called Vb.

In other words, the third period 3 may be a detection period and a voltage of the first electrode of the third transistor T3 may be measured during the third period 3 after the OLED emits light. Therefore, the voltage variation ΔV can be obtained by comparing the detected voltage value stored in the ADC during the third period 3 and the initial voltage value stored in the ADC during the first period 1. In other words, the voltage variation ΔV may be Vb−Va.

Accordingly, the voltage variation ΔV corresponding to information of pixel degradation resulting from light emission of the OLED may be obtained through the first to third periods.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims, and equivalents thereof.

What is claimed is:

1. A display device comprising:

a scan driver configured to transmit a plurality of scan signals to a plurality of scan lines;

a data driver configured to transmit a plurality of data signals to a plurality of data lines;

a selector driver configured to transmit a plurality of selection signals to a plurality of selection signal lines;

a sensor driver configured to receive a plurality of output signals through the plurality of data lines; and a plurality of pixels coupled to the scan lines, the data lines, and the selection signal lines, wherein each of the plurality of pixels comprises:

an organic light emitting diode between a first power supply and a second power supply;

a first transistor configured to transmit a drive current based on the data signals to the organic light emitting diode;

a second transistor configured to couple a gate electrode of the first transistor to a corresponding data line of the data lines in response to one of the plurality of scan signals;

a first capacitor between the first power supply and the gate electrode of the first transistor;

a light receiving element coupled to a third power supply;

a second capacitor between the light receiving element and a fourth power supply;

a third transistor between the corresponding data line and a second electrode of the second capacitor, the third transistor comprising a gate electrode coupled to one of the plurality of selection signal lines; and a fourth transistor between the fourth power supply and the third transistor, the fourth transistor comprising a gate electrode coupled to a first electrode of the second capacitor.

2. The display device of claim 1, wherein the light receiving element comprises at least one of a PIN diode in which a cathode is coupled to the third power supply and an anode is coupled to the first electrode of the second capacitor, a PN diode, or a photocoupler.

3. The display device of claim 1, wherein the third transistor comprises a first electrode coupled to the corresponding data line and a second electrode coupled to the first electrode of the fourth transistor.

4. The display device of claim 1, wherein the fourth transistor comprises a first electrode coupled to a second electrode of the third transistor and comprises a second electrode coupled to the fourth power supply.

5. The display device of claim 1, further comprising a first switch between the data driver and the corresponding data line.

6. The display device of claim 5, further comprising a second switch between the sensor driver and the corresponding data line.

7. The display device of claim 6, further comprising:

a fifth power supply; and a third switch between the fifth power supply and the second switch.

8. The display device of claim 6, wherein the sensor driver comprises an analog-to-digital converter (ADC) coupled to the corresponding data line.

9. A method of driving a display device comprising: a scan driver configured to transmit a plurality of scan signals to a plurality of scan lines; a data driver configured to transmit a plurality of data signals to a plurality of data lines; a selector driver configured to transmit a plurality of selection signals to a plurality of selection signal lines; a sensor driver configured to receive a plurality of output signals through the plurality of data lines; and a plurality of pixels coupled to the scan lines, the data lines, and the selection signal lines; a first switch between the data driver and a corresponding data line of the data lines; a second switch between the sensor driver and the corresponding data line; and a third switch between a fifth power supply and the second switch, wherein each of the plurality of pixels comprises: an organic light emitting diode (OLED) between a first power supply and a second power supply; a first transistor configured to transmit a drive current based on the data signals to the OLED; a second transistor configured to couple a gate electrode of the first transistor to the corresponding data line in response to one of the plurality of scan signals; a first capacitor between the first power supply and the gate electrode of the first transistor; a light receiving element coupled to a third power supply; a second capacitor between the light receiving element and a fourth power supply; a third transistor between the corresponding data line and a second electrode of the second capacitor, the third transistor comprising a gate electrode coupled to one of the plurality of selection signal lines; and a fourth transistor between the fourth power supply and the third transistor, the fourth transistor comprising a gate electrode coupled to a first electrode of the second capacitor, the method comprising:

initial voltage storing in which a voltage of a first electrode of the third transistor is stored in the sensor driver through the corresponding data line;

photosensing in which the OLED emits light by the drive current based on one of the plurality of data signals and a voltage of the second capacitor varies with photo-leakage current generated according to intensity of light incident onto the light receiving element; and detected voltage storing in which the voltage of the first electrode of the third transistor reflecting the varying voltage of the second capacitor is stored in the sensor driver through the corresponding data line.

10. The method of claim 9, further comprising:

calculating a voltage variation of the second capacitor by a comparison of the initial voltage and the detected voltage by the sensor driver;

determining degradation information of each pixel utilizing the voltage variation of the second capacitor; and transmitting a corrected data signal to a degraded pixel.

11. The method of claim 9, wherein the initial voltage storing comprises:

a first step in which the first switch is turned off, the second switch is turned on, the third switch is turned on, a third power supply voltage is applied to a cathode of the light receiving element, the third transistor is switch-operated in accordance with the selection signals so as to couple a first electrode of the fourth transistor to the corresponding data line, the second transistor is turned off, and a fifth power supply voltage is applied to the first electrode of the third transistor through the corresponding data line; and a second step in which the third switch is turned off, and the voltage of the first electrode of the third transistor is stored in the sensor driver through the corresponding data line.

12. The method of claim 11, wherein during the first step, the first switch is turned off so as to disconnect the data driver from the corresponding data line, the second switch is turned on so as to couple the sensor driver and the corresponding data line, the third switch is turned on so as to couple the fifth power supply voltage and the corresponding data line, and the third power supply voltage is applied to the cathode of the light receiving element such that a voltage corresponding to the third power supply voltage is stored in the second capacitor.

13. The method of claim 9, wherein during the photosensing, the first switch is turned on, the second switch is turned off, the third switch is turned off, the second transistor is switch-operated based on the scan signals such that the gate electrode of the first transistor is coupled to the corresponding data line, the third transistor is turned off, and the voltage of the second capacitor varies with photo-leakage current generated according to intensity of light incident onto the light receiving element.

14. The method of claim 9, wherein the detected voltage storing comprises:

a fourth step in which the first switch is turned off, the second switch is turned on, the third switch is turned on, the third transistor is switch-operated in accordance with the selection signals so as to couple the first electrode of the fourth transistor to the corresponding data line, the second transistor is turned off, and the fifth power supply is applied to the first electrode of the third transistor through the corresponding data line; and a fifth step in which the third switch is turned off, and the voltage of the first electrode of the fourth transistor reflecting the voltage of the second capacitor, which varies during the photosensing, is stored in the sensor driver through the corresponding data line.

15. The method of claim 14, wherein during the fourth step, the first switch is turned off so as to disconnect the data driver from the corresponding data line, the second switch is turned on so as to couple the sensor driver and the corresponding data line, and the third switch is turned on so as to couple the fifth power supply and the corresponding data line.

* * * * *